US010602253B2

(12) United States Patent
Litovsky et al.

(10) Patent No.: US 10,602,253 B2
(45) Date of Patent: Mar. 24, 2020

(54) OPEN AUDIO DEVICE WITH REDUCED SOUND ATTENUATION

(71) Applicant: Bose Corporation, Framingham, MA (US)

(72) Inventors: Roman Litovsky, Newton, MA (US); Cory Roberts, Mendon, MA (US); Michael Tiene, Franklin, MA (US)

(73) Assignee: Bose Corporation, Framingham, MA (US)

( * ) Notice: Subject to any disclaimer, the term of this patent is extended or adjusted under 35 U.S.C. 154(b) by 0 days.

(21) Appl. No.: 15/941,691

(22) Filed: Mar. 30, 2018

(65) Prior Publication Data

US 2019/0306603 A1 Oct. 3, 2019

(51) Int. Cl.

| | |
|---|---|
| ***H04R 25/00*** | (2006.01) |
| ***H04R 1/08*** | (2006.01) |
| ***H04R 1/02*** | (2006.01) |
| ***H04R 1/28*** | (2006.01) |

(52) U.S. Cl.

CPC ..... *H04R 1/083* (2013.01); *H04R 1/025* (2013.01); *H04R 1/026* (2013.01); *H04R 1/2892* (2013.01)

(58) Field of Classification Search

CPC ..... H04R 1/083; H04R 1/025; H04R 1/026; H04R 1/2892

USPC ..... 381/361

See application file for complete search history.

(56) References Cited

U.S. PATENT DOCUMENTS

| | | | | |
|---|---|---|---|---|
| 5,212,734 | A * | 5/1993 | Tsao | H04R 5/023 381/301 |
| 6,091,832 | A * | 7/2000 | Shurman | G02C 11/06 2/422 |
| 6,603,863 | B1 * | 8/2003 | Nagayoshi | H04R 1/1066 381/370 |
| 9,445,175 | B2 * | 9/2016 | Seo | H04M 1/035 |
| 9,571,917 | B2 * | 2/2017 | Litovsky | H04R 1/105 |
| 9,654,867 | B2 * | 5/2017 | Litovsky | H04R 1/347 |
| 9,736,574 | B2 | 8/2017 | Litovsky et al. | |
| 9,794,683 | B2 * | 10/2017 | Kim | H04R 1/323 |
| 9,838,787 | B1 | 12/2017 | Jeffery et al. | |
| 9,877,103 | B2 | 1/2018 | Litovsky et al. | |
| 9,985,596 | B1 * | 5/2018 | Litovsky | H03G 5/165 |
| D830,341 | S * | 10/2018 | Yokozeki | D14/210 |
| 10,244,311 | B2 * | 3/2019 | Litovsky | H04R 5/0335 |
| 2016/0021446 | A1 * | 1/2016 | Litovsky | H04R 1/347 381/338 |
| 2016/0021449 | A1 * | 1/2016 | Litovsky | H04R 1/105 381/374 |
| 2016/0337747 | A1 * | 11/2016 | Litovsky | H04R 5/0335 |
| 2017/0111733 | A1 * | 4/2017 | Litovsky | H04R 1/105 |
| 2017/0295431 | A1 * | 10/2017 | Son | H04R 1/1016 |
| 2019/0183388 | A1 * | 6/2019 | Cohen | A61B 5/1116 |

* cited by examiner

*Primary Examiner* — Phylesha Dabney
(74) *Attorney, Agent, or Firm* — Brian M. Dingman; Dingman IP Law, PC

(57) ABSTRACT

An open audio device with a housing that is configured to be worn on the torso and an acoustic transducer carried by the housing, the acoustic transducer configured to either radiate sound outwardly of the housing or convert received sound into an electrical signal. A structure is coupled to the housing. The structure is proximate to the acoustic transducer. The structure is constructed and arranged to inhibit radiated sound or received sound from being interrupted by a flexible sheet material, such as clothing, located over the housing.

18 Claims, 7 Drawing Sheets

OPEN AUDIO DEVICE WITH REDUCED SOUND ATTENUATION

BACKGROUND

This disclosure relates to an open audio device.

Some open audio devices are configured to be worn on the torso. The devices can have one or more acoustic transducers, such as acoustic drivers and/or microphones. If the open audio device is worn under clothing, the clothing can cover the acoustic transducers, and inhibit sound pressure from reaching the ears or inhibit sound pressure from reaching the microphone. Clothing can thus muffle the sound from or to the open audio device.

SUMMARY

All examples and features mentioned below can be combined in any technically possible way.

In one aspect, an open audio device includes a housing that is configured to be worn on the torso, an acoustic transducer carried by the housing, the acoustic transducer configured to either radiate sound outwardly of the housing or convert received sound into an electrical signal, and upstanding structure coupled to the housing proximate to the acoustic transducer, the upstanding structure constructed and arranged to inhibit radiated sound or received sound from being interrupted by a flexible sheet material (e.g., clothing) located over the housing.

Embodiments may include one of the above and/or below features, or any combination thereof. The housing can include a neck loop that is configured to be worn around at least a portion of a user's neck, the neck loop comprising a central portion that has opposed ends, and a depending portion that extends from one end of the central portion, and wherein the acoustic transducer comprises an acoustic driver in the depending portion. The upstanding structure may comprise a plurality of upstanding ribs that project above a surface of the depending portion. The ribs may be essentially parallel to one another. The open audio device may further comprise a sound outlet opening in the depending portion proximate the acoustic driver, and there may be a rib proximate the acoustic driver, a rib proximate the sound outlet opening, and a rib between the acoustic driver and the sound outlet opening.

Embodiments may include one of the above and/or below features, or any combination thereof. The upstanding structure can cover at least part of the depending portion. The upstanding structure can comprise an upper surface spaced directly above the depending portion, wherein the upper surface is essentially acoustically transparent. The upstanding structure may further comprise an angled portion between its upper surface and the depending portion of the neck loop, wherein the angled portion comprises an opening that is configured to pass sound therethrough. The angled portion of the upstanding structure can be configured to be closer to the mid-sagittal plane than the upper surface of the upstanding structure. The open audio device may further comprise a sound outlet opening in the depending portion proximate the acoustic driver, wherein the upper surface of the upstanding structure is spaced directly above the acoustic driver and the sound outlet opening. The open audio device may further comprise a microphone in the depending portion proximate the acoustic driver and the upper surface of the upstanding structure may be spaced directly above the microphone.

Embodiments may include one of the above and/or below features, or any combination thereof. The upstanding structure may comprise a cage that projects above the acoustic transducer. The housing may comprise a neck loop that is configured to be worn around at least a portion of a user's neck, the neck loop comprising a central portion that has opposed ends, and a depending portion that extends from one end of the central portion, and wherein the acoustic transducer comprises an acoustic driver in the depending portion. The depending portion may have an upper surface and first and second opposed sides, wherein the first side is configured to be closer to the mid-sagittal plan than the second side. The cage may have a first side that is proximate the first side of the depending portion and a second side that is proximate the second side of the depending portion. The cage may have a height from the upper surface of the depending portion, and the height may vary from the cage first side to the cage second side. The first side of the cage may be higher than the second side of the cage. The cage may comprise an elongated opening along its first side. The open audio device may further comprise an acoustic waveguide that is acoustically coupled to the acoustic driver, and the acoustic waveguide may have an open area, and the area of the elongated opening may have an overall opening area that is at least equal to the open area of the acoustic waveguide.

In another aspect, an open audio device includes a housing that is configured to be worn on the torso, wherein the housing comprises a neck loop that is configured to be worn around at least a portion of a user's neck, the neck loop comprising a central portion that has opposed first and second ends, a first depending portion that extends from the first end of the central portion, and a second depending portion that extends from the second end of the central portion. There is a first acoustic driver in the first depending portion of the housing and a second acoustic driver in the second depending portion of the housing, both acoustic drivers configured to radiate sound outwardly of the housing. There are first and second upstanding structures coupled to the first and second depending portions of the housing, respectively, the first upstanding structure proximate to the first acoustic driver, and the second upstanding structure proximate to the second acoustic driver, the upstanding structures each constructed and arranged to inhibit radiated sound from being interrupted by clothing located over the housing.

In another aspect, an open audio device includes a housing that is configured to be worn on the torso, wherein the housing comprises a neck loop that is configured to be worn around at least a portion of a user's neck, the neck loop comprising a central portion that has opposed first and second ends, a first depending portion that extends from the first end of the central portion, and a second depending portion that extends from the second end of the central portion, wherein the first depending portion has an upper surface and first and second opposed sides, wherein the first side is configured to be closer to the mid-sagittal plan than the second side, and wherein the second depending portion has an upper surface and first and second opposed sides, wherein the first side is configured to be closer to the mid-sagittal plan than the second side. There is a first acoustic driver in the first depending portion of the housing and a second acoustic driver in the second depending portion of the housing, both acoustic drivers configured to radiate sound outwardly of the housing. There are first and second cages coupled to the first and second depending portions of the housing, respectively, the first cage projecting directly above the first acoustic driver, and the second cage projecting directly above the second acoustic driver, the cages each constructed and arranged to hold clothing off the driver and thus inhibit radiated sound from being interrupted by clothing located over the housing. The first cage has a first side that is proximate the first side of the first depending portion and a second side that is proximate the second side of the first depending portion, the first side of the first cage is higher than the second side of the first cage, and the first cage comprises an elongated opening along its first side. The second cage has a first side that is proximate the first side of the second depending portion and a second side that is proximate the second side of the second depending portion, the first side of the second cage is higher than the second side of the second cage, and the second cage comprises an elongated opening along its first side.

DETAILED DESCRIPTION

An open audio device with reduced muffling can include a housing that is configured to be worn on the torso, and an acoustic transducer (an acoustic driver and/or a microphone) carried by the housing. The driver is configured to radiate sound outwardly of the housing, while the microphone is configured to convert received sound into an electrical signal. Muffling of the driver and microphone can be reduced with an upstanding structure coupled to the housing proximate to the acoustic transducer(s). The upstanding structure helps to prevent flexible material such as overlying clothing from contacting the transducer(s) or contacting the device housing at the location of the transducer(s). This allows sound pressure to be radiated from or received by the transducer(s) with less interruption by the clothing. A result is that the sound is less muffled than it would have been without the upstanding structure.

Figure 1:
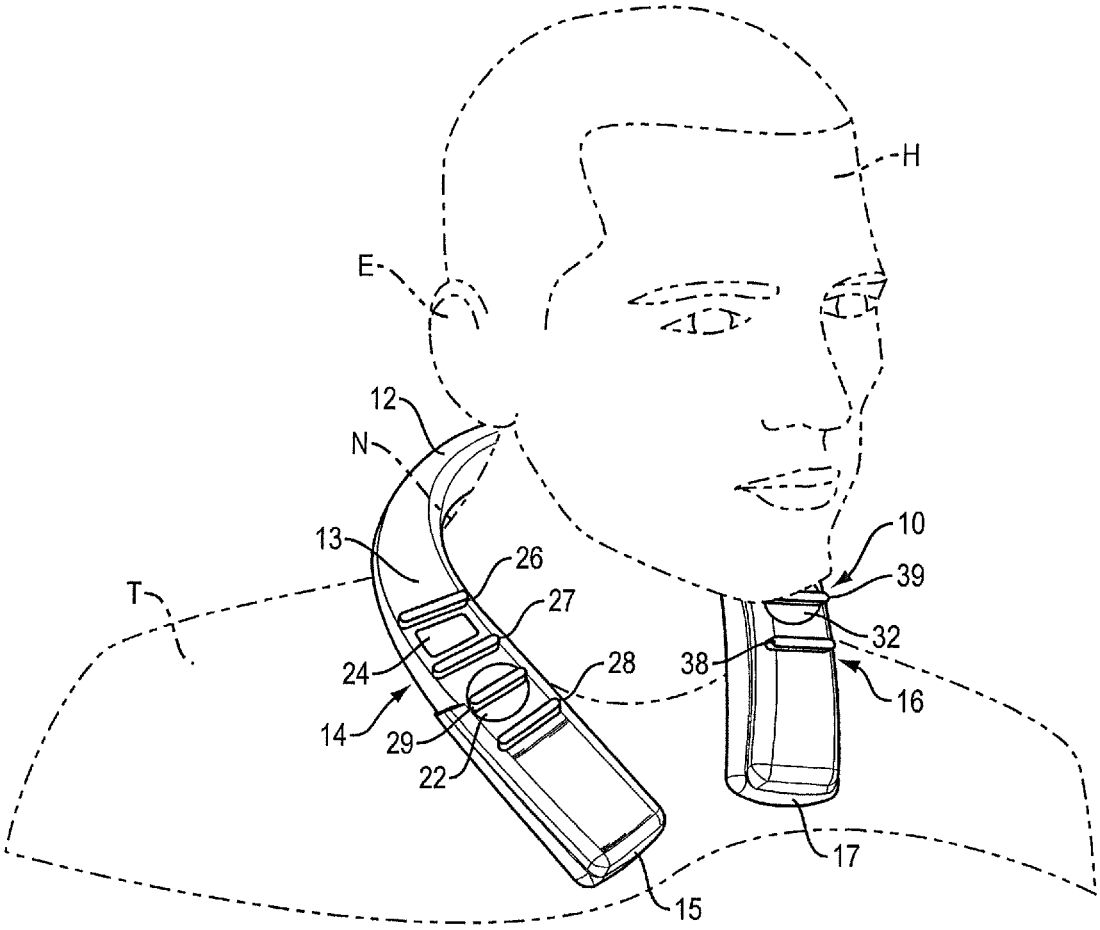
FIG. 1 shows an open audio device worn on the torso of a user.

FIG. 1 illustrates one non-limiting example of an open audio device 10 with a housing 12 that is configured to be worn on the body of a person. The person has a head H with ear E, a neck N, and a torso T. Housing 12 in this example is a generally "U"-shaped structure (a neck loop) that is worn around the neck and on the torso. Housing 12 is symmetric about the mid-sagittal plane of the wearer. Housing 12 has central portion 13 with right and left ends that merge into right depending portion 14 and left depending portion 16, respectively. Portion 14 has distal end 15. Portion 16 has distal end 17. It should be understood that the central portion and depending portions can be designated portions of a continuous housing as opposed to discrete portions of the neck loop that are coupled together, although the neck loop could be constructed from separate portions or constructed in other manners without limiting the scope of the present disclosure.

Housing 12 carries one or more acoustic transducers. In this non-limiting example, housing 12 carries two transducers, both of which are acoustic drivers. Driver 22 is located in right depending portion 14, and driver 32 is located in left depending portion 16. In this non-limiting example, each depending portion also includes a waveguide outlet; waveguide outlet 24 in portion 14 can be seen. Waveguide outlet 24 can be an outlet of a waveguide that is acoustically coupled to the back side of driver 32. There is also a waveguide outlet in portion 16 (not visible in this view) that is acoustically coupled to the back side of driver 22. Housing 12 may additionally or alternatively carry one or more microphones. Normally it would be expected that some type of ergonomic cover (not shown), such as a stretch fabric cover, would cover most or all of device 10. The cover could be used to hide the transducers and waveguide openings and ribs, and also is a means to create a particular appearance or color to the device. Additional details of an open audio device similar to device 10 are disclosed in U.S. Pat. Nos. 9,736,574, 9,838,787, and 9,877,103, the disclosures of which are incorporated herein by reference in the entireties.

The open audio device includes an upstanding structure coupled to the housing. The upstanding structure may be located above and/or proximate to and spaced from, the acoustic transducer. The upstanding structure is constructed and arranged to inhibit radiated sound or received sound from being interrupted by a flexible sheet material (e.g., clothing) located over the housing. In this non-limiting example, device 10 includes upstanding spaced ribs 26, 27, 28, and 29 in right depending portion 14, and a similar set of upstanding spaced ribs in left depending portion 16 (only two ribs 38 and 39 visible). The ribs are preferably but not necessarily located above and/or close to each transducer, and close to but not above each waveguide outlet, as shown. The ribs are preferably but not necessarily not directly above a waveguide outlet, to avoid creating excessive noise. The ribs preferably but not necessarily extend across the width of the depending portions, as shown. The ribs are preferably but not necessarily essentially parallel to one another, as shown.

The upstanding structure is effective to hold at least some types of clothing or any other flexible sheet-type material (e.g., an accessory such as a scarf) off of the surface of the housing at the locations of the transducers and/or the waveguide outlets. By doing so, a space (an acoustic volume) is created between the housing and the overlying sheet material. Without the upstanding structure, clothing could cover and mask (muffle) the transducers/waveguide outlets. With the upstanding structure, sound pressure has an opportunity to travel to/from the environment from/to the transducer/waveguide outlet via the created acoustic volume. This way, there is the potential for less muffling of the transducer(s)/waveguide outlet(s), which leads to better sound quality.

Figure 2:
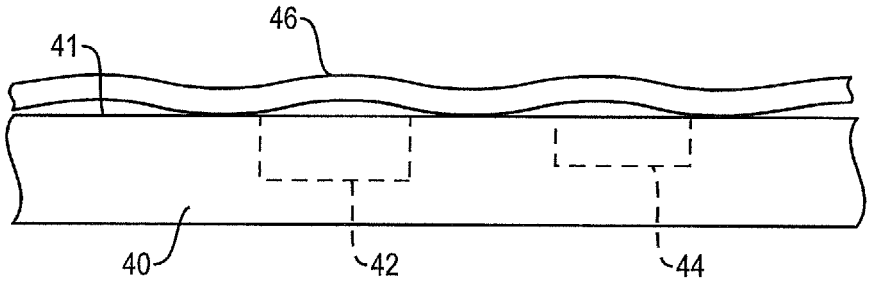
FIG. 2 (PRIOR ART)
FIG. 2 is a partial side view of a prior art open audio device that is being muffled by an overlying flexible sheet material, such as clothing.
Figure 3:
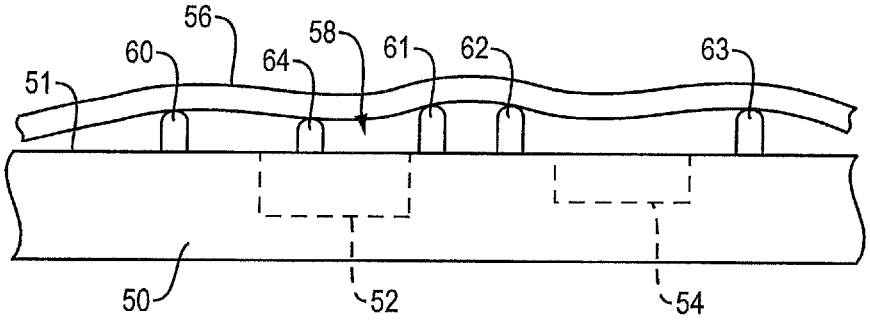
FIG. 3 is a partial side view of an open audio device covered by clothing, where the overlying clothing is held off the surface, so as to reduce muffling.

FIG. 2 illustrates a problem when clothing 46 overlies the portion 40 of the acoustic device housing that caries one or both of driver 42 and adjacent waveguide outlet 44. Clothing 46 can sit directly on or very close to upper surface 41 of housing portion 40. Clothing 46 can thus muffle the transducers. FIG. 3 is a similar view of open audio device housing portion 50 that carries one or more transducers—in this case, driver 52 and waveguide outlet or microphone 54. Upstanding structures (e.g., ribs) 60-64 extend above upper surface 51 of portion 50 and are constructed and arranged to hold clothing 56 off of surface 51, at least at the areas that are directly over the relevant transducers/waveguide outlets. Space/volume 58 is created, within which the sound pressure can propagate. There is thus less muffling of sound from/to the transducers than there is without the structures as in FIG. 2. Note that structures 60-64 do not need to be ribs but could be other types of structures, such as a plurality of nibs near the transducer(s), or annular or other shape structures fully or partially surrounding a transducer and projecting upwardly from the housing surface proximate the transducer. In one non-limiting example, ribs 60-64 are structured and arranged much like ribs 26-29, FIG. 1. It is believed that ribs that are at least about 3-5 mm high can be effective to hold clothing off the transducers, as described herein. Taller structures could be used, of course, but the likely minimal additional anti-muffling effects of taller structures may be offset by the possibly deleterious effects to the appearance of the device with tall protruding structures.

Figure 4:
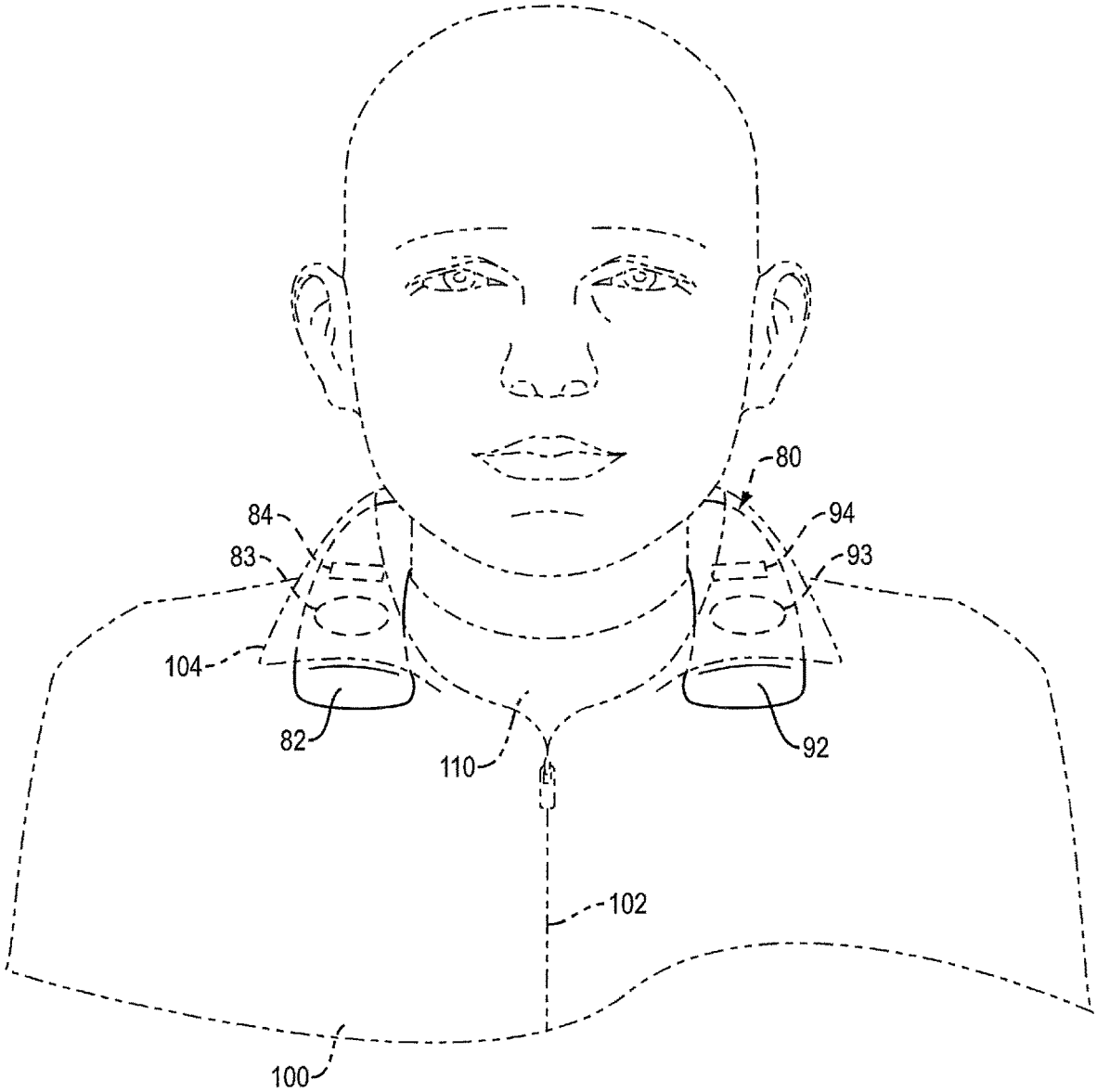
FIG. 4 is a view similar to that of FIG. 1, illustrating the open audio device being worn underneath a coat.
Figure 8:
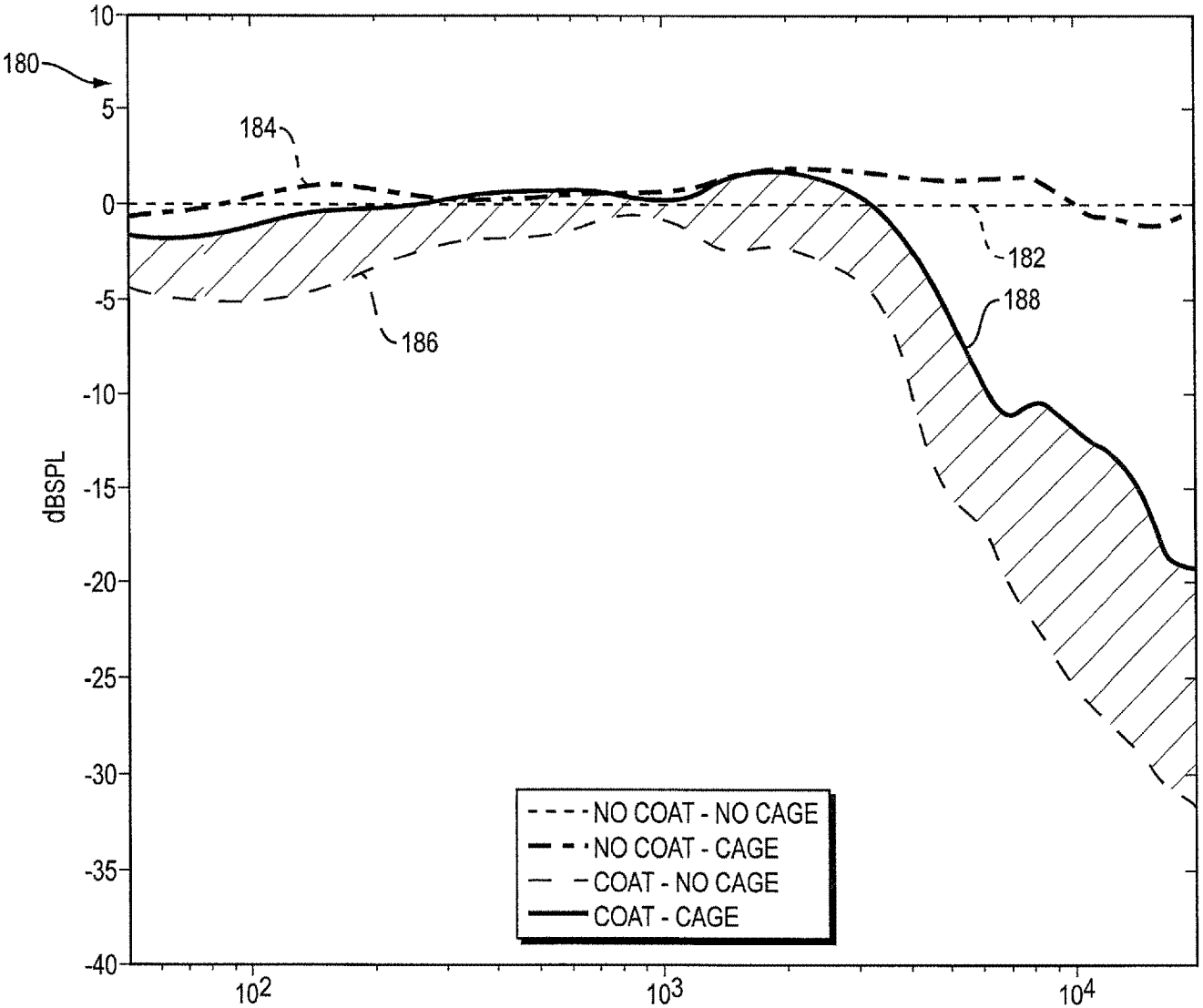
FIG. 8 is a plot illustrating the anti-muffling accomplished by the open audio device illustrated in FIG. 6.

FIG. 4 shows open audio device 80 in a use situation, worn on the torso underneath coat or sweater (clothing) 100. Clothing 100 is shown in phantom to better illustrate aspects of the disclosure. Open audio device 80 comprises right depending portion 82 that carries audio driver 83 and waveguide outlet 84 and left depending portion 92 that carries audio driver 93 and waveguide outlet 94. Clothing 100 has collars 104 that overlie depending portions 82 and 92, and thus will compromise the quality of sound delivered by the transducers and the waveguide outlets. Clothing 100 has zipper 102 and does not cover open neck region 110. For sound to reach the ears, it must either travel through the clothing or escape from under the clothing into neck region 110, where it reaches the environment and so can travel to the ears. However, since as shown in FIG. 2 clothing may lie directly on top of the sound-emitting features of the open audio device, clothing 100 is very likely to substantially attenuate the sound pressure (or amplitude) reaching the listener (i.e., muffle the sound). Some of the effects are illustrated in FIG. 8 and described below.

Figure 5:
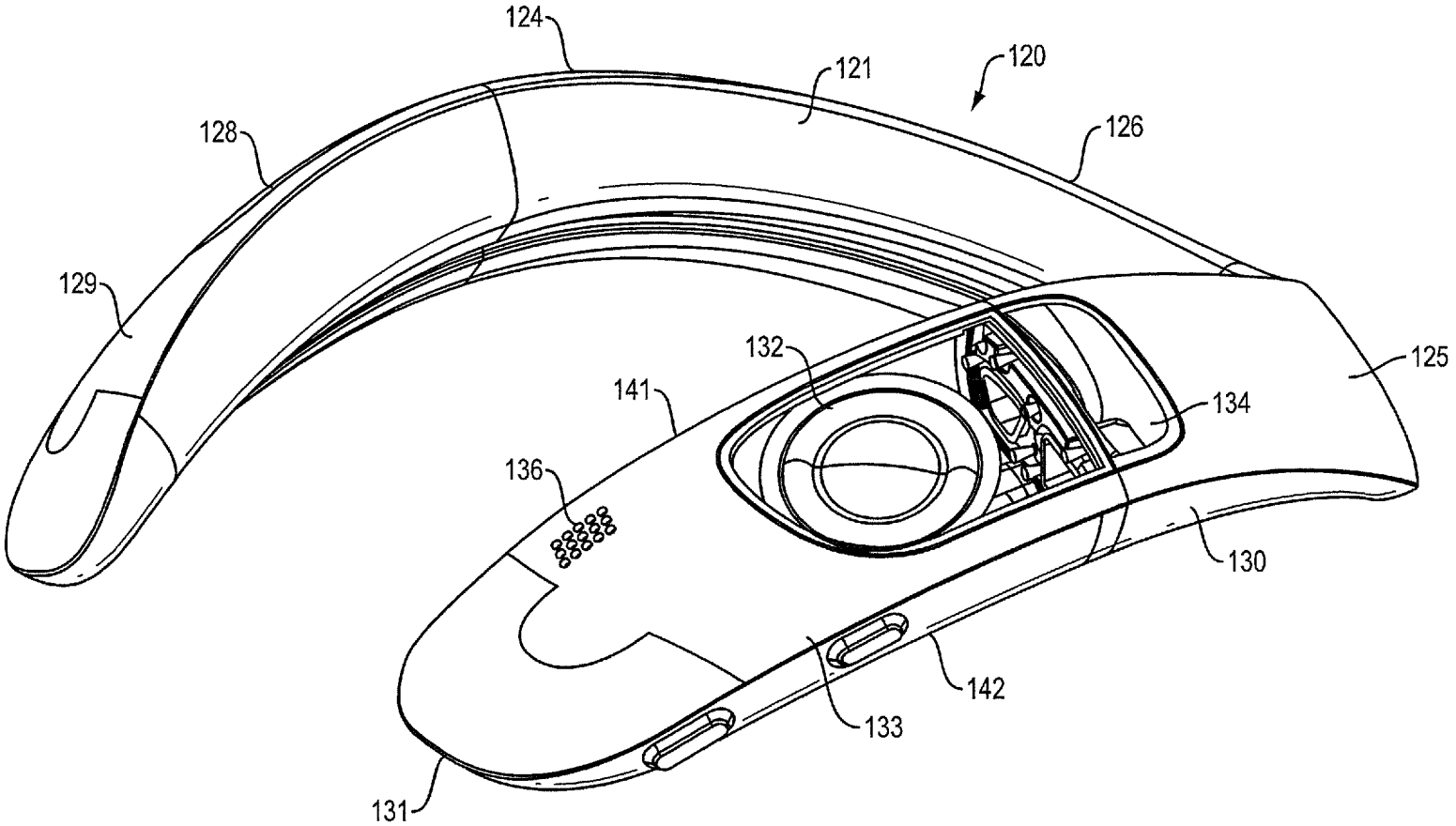
FIG. 5 is a top perspective view of a partially disassembled open audio device, illustrating an acoustic driver, a waveguide outlet, and a microphone.

FIG. 5 is a top perspective view of a partially disassembled open audio device 120, illustrating an acoustic driver 132, a waveguide outlet 134, and an opening or screen 136 that leads to a microphone (not shown) located below opening 136. Open audio device 120 may be a Soundwear® Companion speaker device available from Bose Corporation, Framingham, Mass., USA. Housing 121 is a neck loop that comprises central portion 126 with right end region 124 and left end region 125 that transition into right depending portion 128 and left depending portion 130, respectively. Depending portion 128 has upper surface 129, first (inner) side 143 that is closest to the mid-sagittal plane and opposed second (outer) side 144 that is farthest from the mid-sagittal plane. Similarly, depending portion 130 has upper surface 133, first (inner) side 141 that is closest to the mid-sagittal plane, and opposed second (outer) side 142 that is farthest from the mid-sagittal plane. Housing 121 would normally include a cover located over driver 132, which is not shown so that the relationship of the driver, waveguide outlet, and microphone can be visualized. Any clothing or other flexible sheet material lying on top surface 129 or 133 will muffle the sound and so have a negative effect on the use of device 120.

Figure 6:
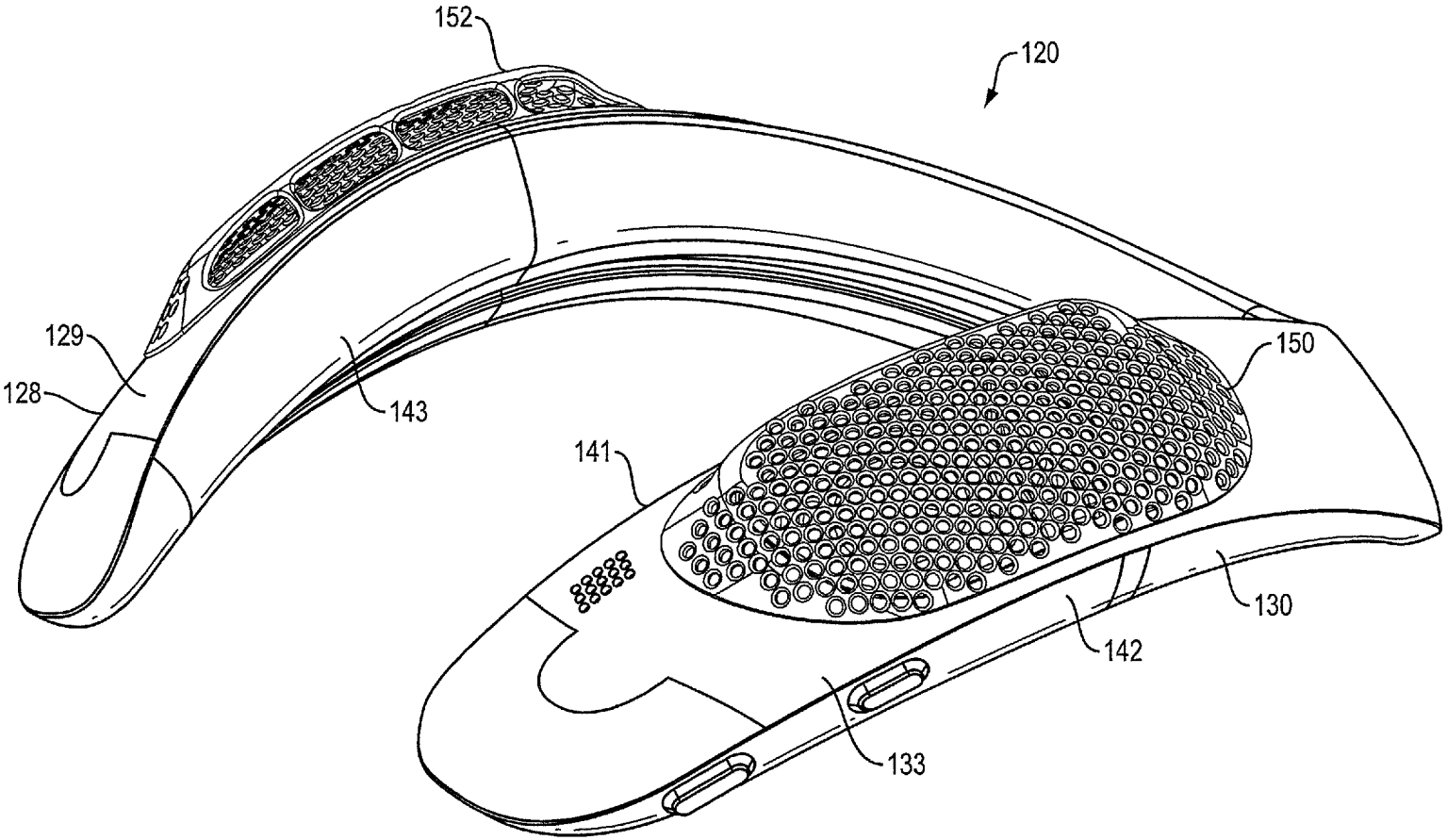
FIG. 6 illustrates the fully assembled open audio device of FIG. 5, with cages.

FIG. 6 illustrates the fully assembled open audio device 120 of FIG. 5 according to aspects of the present disclosure. Cage 150 is located over upper surface 133 of portion 130, covering the driver and the waveguide outlet. Similarly, cage 152 is located over upper surface 129 of portion 128, covering the driver and the waveguide outlet. Cages 150 and 152 can be essentially identical, but arranged to fit one of the depending portions, as explained below. Although not shown in FIG. 6, the cage can also be located directly over any microphone (or, close enough to hold some clothing off the audio device surface above the microphone), so that the cage is also effective to inhibit muffling of sound picked up by the microphone. The cages can be held in place on the housing in any desired manner. For example, they can be permanently mounted to the housing or removably coupled to the housing using releasable mechanical coupling such as tabs that fit into slots. Or, if the audio device includes a stretch fabric cover (to improve the appearance), the cages can be built into the cover, or they could be held in place on the housing by the cover.

Figure 7:
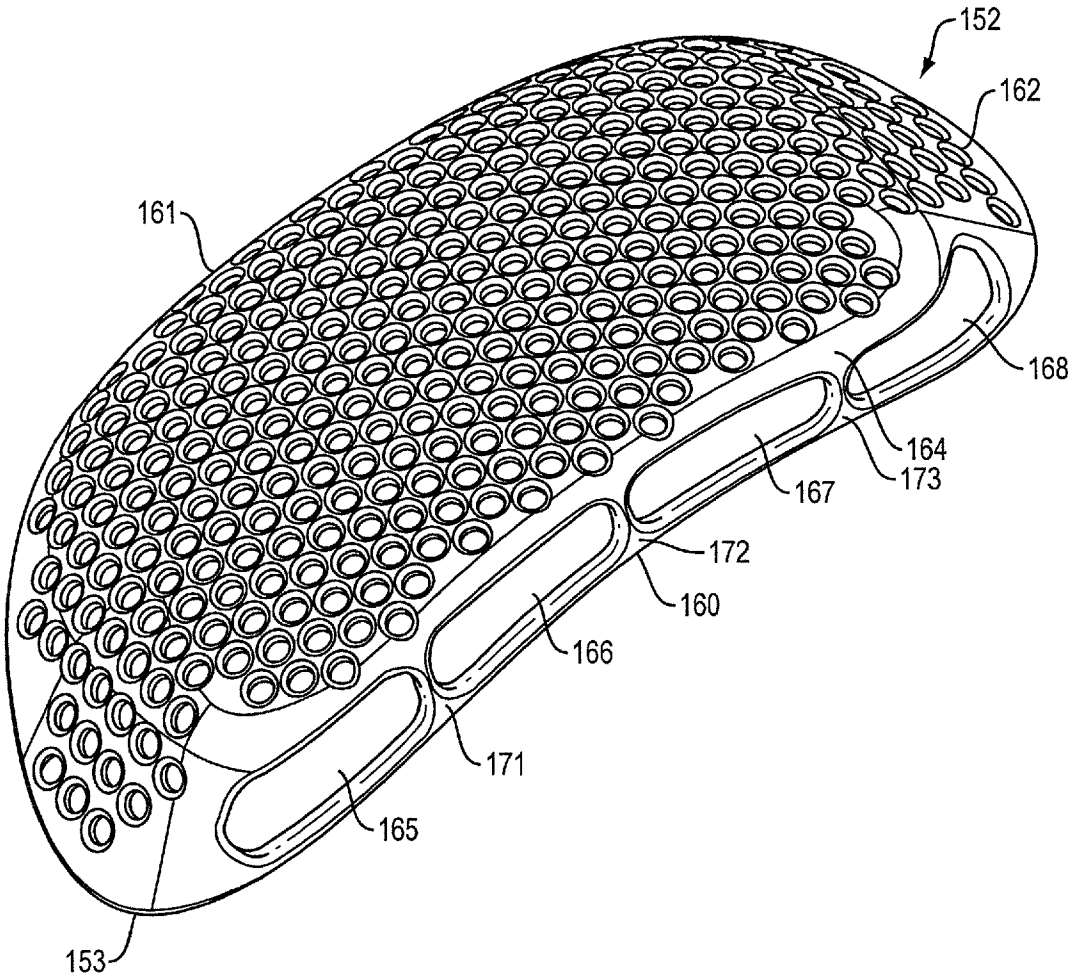
FIG. 7 is a close-up view of one of the cages of the open audio device of FIG. 6.

FIG. 7 is a close-up view of one cage 152. Cage 152 is an upstanding structure that covers the part of a depending portion of the audio device that comprises at least one audio transducer or waveguide outlet. Cage 152 has an upper surface 162 that is spaced directly above upper surface 129 of depending portion 128. Upper surface 162 includes a plurality of openings of sufficient size and extent to make it essentially acoustically transparent. This way, the cages do not have a substantial impact on sound quality when the open audio device is worn on top of clothing.

Cage 152 has lower rim 153 that sits on or otherwise engages with the audio device depending portion so that it is held in place in the desired location. Cage 152 further comprises an angled portion 164 between its upper surface 162 and lower rim 153. Angled portion 164 includes one or more openings that are configured to pass sound therethrough. Accordingly, if clothing or another type of flexible sheet material is lying on surface 162, sound can escape or enter via these angled portion opening(s). In the present non-limiting example, openings 165, 166, 167, and 168 are formed in angled portion 164. Having multiple openings allows ribs 171-173 to be located between the openings, to provide strength so that the cage is more rigid and better able to withstand crushing forces. In general, the height of any opening should be large enough such that the opening does not act as a resonating waveguide. It is expected that this height should be at least about 1 mm. Also, since in this non-limiting example the open audio device uses waveguides to help deliver sound, it is desirable but not necessary that the overall area of openings 165-168 be at least equal to the open area of the waveguide. In one example the waveguide area is about 0.5-0.6 $cm^2$, and so the area of openings 165-158 in sum is at least about 0.5-0.6 $cm^2$.

In this non-limiting example, angled portion 164 is configured to be closer to the mid-sagittal plane than is upper surface 162. This can be accomplished by arranging cage 152 to have a first side 160 that is proximate the first side 143 of depending portion 128, and an opposed second side 161 that is proximate the second side 144 of depending portion 128. Cage 152 can have a height from the upper surface 129 of depending portion 128, where the height varies from the cage first side to the cage second side. In this example, the cage is arranged such that the first side of the cage is higher than the second side of the cage; this helps to keep the profile of the cage lower while at the same time providing an angled portion that has enough height and area to allow for one or more openings that are configured to pass sound substantially unimpeded, as described above. The angle of the angled portion to the upper surface should be steep enough to prevent the clothing from draping over and sitting directly on the angled portion and thus blocking the openings in the angled portion. The particular angle is likely not critical. In one non-limiting example the angle is the result of the width of the audio device depending portion and the height required on the inner side (the first side) of the cage. In one illustrative non-limiting example the angle between upper surface 162 and angled portion 164 should be about 100 degrees or less.

FIG. 8 is a plot illustrating the anti-muffling accomplished by the open audio device illustrated in FIGS. 5 and 6. Measurements were taken at the ears of a mannequin, with a setup such as shown in FIG. 4. The device without cages (as shown in FIG. 5) was placed around the neck and over the shoulders/upper torso, plot line 182. The rest of the measurements were normalized to this plot. A coat 100 was then placed over the device with the zipper zipped up to leave open area 110, FIG. 4. Measurements are illustrated by plot line 186. As can be seen, below about 1000 Hz the sound pressure level (SPL) decreased by up to about 5 dB. Above 1000 Hz the results were dramatically worse, with decreases of about 30 dB. The device with cages (as shown in FIG. 6) were then used in the same manner—measured without the coat (plot line 184) and with the coat (plot line 188). It is believed that the cages themselves do not actually have any significant impact on the sound and that any differences between plots 182 and 814 are due primarily to slight differences in the experimental setup (the measurements were made on different days). The differences between plots 188 and 186 (shaded in the drawing) illustrate beneficial effects of the cages. Below about 1000 Hz there is virtually no sound attenuation with the cages. Above about 3000 Hz the results with the cages are in the range of about 5 to about 12 dB better than without the cages. Thus, the cages advantageously restore low frequencies and frequencies in the voice band, the latter of which are important for clarity. It is believed that the attenuation above about 3000 Hz with the cages is because with the small wavelength at higher frequencies, even a small amount of clothing or material will absorb sound energy and thus damp the sound.

It is believed that the cages work by allowing sound to escape from the inner edges of the depending portions of the open audio device, which are located close to the inside of the collar region 104, leading directly to open region 110. Thus, sound can move between the depending portions and the environment with substantially less attenuation as compared to the sound pressure needing to move directly through the clothing.

A number of implementations have been described. Nevertheless, it will be understood that additional modifications may be made without departing from the scope of the inventive concepts described herein, and, accordingly, other embodiments are within the scope of the following claims.

What is claimed is:

1. An open audio device, comprising:

a housing that is configured to be worn on the torso, wherein the housing comprises a neck loop that is configured to be worn around at least a portion of a user's neck, the neck loop comprising a central portion that has opposed ends, and a depending portion that extends from one end of the central portion;

an acoustic transducer disposed in the depending portion, the acoustic transducer configured to either radiate sound outwardly of the housing or convert received sound into an electrical signal; and at least one upstanding rib that is coupled to the housing proximate to the acoustic transducer and projects above a surface of the depending portion, the at least one upstanding rib constructed and arranged to inhibit radiated sound or received sound from being interrupted by a flexible sheet material located over the housing.

2. The open audio device of claim 1, comprising a plurality of upstanding ribs that project above the surface of the depending portion.

3. The open audio device of claim 2, wherein the ribs are essentially parallel to one another.

4. The open audio device of claim 3, further comprising a sound outlet opening in the depending portion proximate the acoustic transducer, and wherein there is a rib proximate the acoustic transducer, a rib proximate the sound outlet opening, and a rib between the acoustic transducer and the sound outlet opening.

5. An open audio device, comprising:

a housing that is configured to be worn on the torso, wherein the housing comprises a neck loop that is configured to be worn around at least a portion of a user's neck, the neck loop comprising a central portion that has opposed first and second ends, a first depending portion that extends from the first end of the central portion, and a second depending portion that extends from the second end of the central portion;

a first acoustic driver in the first depending portion of the housing and a second acoustic driver in the second depending portion of the housing, both acoustic drivers configured to radiate sound outwardly of the housing; and first and second upstanding structures coupled to the first and second depending portions of the housing, respectively, the first upstanding structure proximate to the first acoustic driver, and the second upstanding structure proximate to the second acoustic driver, the upstanding structures each constructed and arranged to inhibit radiated sound from being interrupted by clothing located over the housing.

6. An open audio device, comprising:

a housing that is configured to be worn on the torso, wherein the housing comprises a neck loop that is configured to be worn around at least a portion of a user's neck, the neck loop comprising a central portion that has opposed first and second ends, a first depending portion that extends from the first end of the central portion, and a second depending portion that extends from the second end of the central portion, wherein the first depending portion has an upper surface and first and second opposed sides, wherein the first side is configured to be closer to the mid-sagittal plan than the second side, and wherein the second depending portion has an upper surface and first and second opposed sides, wherein the first side is configured to be closer to the mid-sagittal plan than the second side;

a first acoustic driver in the first depending portion of the housing and a second acoustic driver in the second depending portion of the housing, both acoustic drivers configured to radiate sound outwardly of the housing; and first and second cages coupled to the first and second depending portions of the housing, respectively, the first cage projecting directly above the first acoustic driver, and the second cage projecting directly above the second acoustic driver, the cages each constructed and arranged to inhibit radiated sound from being interrupted by clothing located over the housing.

7. The open audio device of claim 6, wherein the first cage comprises an upper surface spaced directly above the first depending portion, wherein the upper surface is essentially acoustically transparent.

8. The open audio device of claim 7, wherein the first cage further comprises an angled portion between its upper surface and the first depending portion of the neck loop, wherein the angled portion comprises an opening that is configured to pass sound therethrough.

9. The open audio device of claim 8, wherein the angled portion of the first cage is configured to be closer to the mid-sagittal plane than the upper surface of the first cage.

10. The open audio device of claim 8, further comprising a first sound outlet opening in the first depending portion proximate the first acoustic driver, wherein the upper surface of the first cage is spaced directly above the first acoustic driver and the first sound outlet opening.

11. The open audio device of claim 7, further comprising a first microphone in the first depending portion proximate the first acoustic driver, and wherein the upper surface of the first cage is spaced directly above the first microphone.

12. The open audio device of claim 6, wherein the first cage has a first side that is proximate the first side of the first depending portion and a second side that is proximate the second side of the first depending portion.

13. The open audio device of claim 6, wherein the first cage has a height from the upper surface of the first depending portion, and the height varies from a first cage first side to a first cage second side.

14. The open audio device of claim 13, wherein the first side of the first cage is higher than the second side of the first cage.

15. The open audio device of claim 14, wherein the first cage comprises an elongated opening along its first side.

16. The open audio device of claim 6, further comprising a first acoustic waveguide that is acoustically coupled to the first acoustic driver, wherein the first acoustic waveguide has an open area, and wherein the area of an elongated opening in the first cage has an overall opening area that is at least equal to the open area of the first acoustic waveguide.

17. The open audio device of claim 6, wherein the first cage has a first side that is proximate the first side of the first depending portion and a second side that is proximate the second side of the first depending portion, the first side of the first cage is higher than the second side of the first cage, and the first cage comprises an elongated opening along its first side.

18. The open audio device of claim 6, wherein the second cage has a first side that is proximate the first side of the second depending portion and a second side that is proximate the second side of the second depending portion, the first side of the second cage is higher than the second side of the second cage, and the second cage comprises an elongated opening along its first side.

* * * * *